United States Patent [19]

van Esdonk et al.

[11] Patent Number: 4,900,285

[45] Date of Patent: Feb. 13, 1990

[54] METHOD OF MANUFACTURING A DISPENSER CATHODE; DISPENSER CATHODE MANUFACTURED ACCORDING TO THE METHOD, AND DEVICE INCORPORATING SUCH A CATHODE

[75] Inventors: Johannes van Esdonk; Jacobus Stoffels, both of Eindhoven, Netherlands

[73] Assignee: U.S. Philips Corporation, New York, N.Y.

[21] Appl. No.: 215,699

[22] Filed: Jul. 5, 1988

[30] Foreign Application Priority Data

Jul. 6, 1987 [NL] Netherlands ..... 8701584

[51] Int. Cl.[4] ..... H01J 9/04

[52] U.S. Cl. ..... 445/50; 313/346 DC

[58] Field of Search ..... 445/50, 51; 313/346 DC

[56] References Cited

U.S. PATENT DOCUMENTS

| | | | |
|---|---|---|---|
| 3,723,589 | 3/1973 | Kennedy | 419/6 |
| 3,842,309 | 10/1974 | Van Stratum et al. | 445/51 |
| 4,400,648 | 8/1983 | Taguchi et al. | 313/346 DC |
| 4,625,142 | 11/1986 | van Esdonk et al. | 313/346 DC |
| 4,671,777 | 6/1987 | van Esdonk et al. | 445/51 |
| 4,767,372 | 8/1988 | Bossert et al. | 445/50 |

*Primary Examiner*—Kenneth J. Ramsey

*Attorney, Agent, or Firm*—John C. Fox

[57] ABSTRACT

A method of producing a dispenser cathode provided with a top layer, in which a main body of tungsten powder is pressed to a moulding at a first pressing pressure which is sufficient to preserve the shape of the moulding when the first pressure is removed but is not sufficient to break the powder grains to a significant extent. This moulding is thereafter provided with a top layer of a second power, whereafter the overall assembly is compressed in a second pressing operation at a second, higher pressing pressure, at which pressure the powder grains are broken to a significant extent.

11 Claims, 2 Drawing Sheets

METHOD OF MANUFACTURING A DISPENSER CATHODE; DISPENSER CATHODE MANUFACTURED ACCORDING TO THE METHOD, AND DEVICE INCORPORATING SUCH A CATHODE

BACKGROUND OF THE INVENTION

The invention relates to a method of manufacturing a dispenser cathode comprising a porous cathode body which predominantly consists of a refractory metal or refractory metal alloy and being provided with a top layer which differs from the rest of the cathode body, the method comprising pressing a powder predominantly comprising a refractory metal or refractory alloy to form a body.

Dispenser cathodes of this type are used in electron guns for electron tubes such as television picture tubes, picture pick-up tubes, travelling-wave tubes, clystrons, transmitter tubes and the like.

Dispenser cathodes comprise a reservoir of emitter material to provide an adequately low exit potential for electrons at emitting surface. Dispenser cathodes of the type described in the opening paragraph comprise a porous impregnated body, having a top layer which differs from the rest of the body. It is desirable for the top layer to have properties which are advantageous for the emission of electrons, while the rest of the body has properties which are advantageous for the storage of emitter material. To that end, in said dispenser cathodes, the top layer is formed by a layer which has a composition and/or porosity differing from the rest of the body. The porosity of the top layer and of the rest of the body determine the total maximum quantity of emitter material to be stored in the body, the active surface area and the diffusion rate of active elements from the cathode body to the emissive surface. A low porosity of the top layer combined with a high porosity of the rest of the body combines a relatively slow diffusion rate of active elements to the emissive surface with a relatively large storage capacity, which has a favourable effect on the operating life of the cathode. It is alternatively possible to provide a top layer with emission-stimulating material (e.g. $Sc_2O_3$). In U.S. Pat. No. 4,625,142, a cathode body is pressed from a tungsten powder, on which, prior to pressing, a 0.2 mm thick layer of a mixture of 95% by weight of tungsten powder and 5% by weight of scandium oxide powder ($Sc_2O_3$) is provided. After pressing and sintering, the cathode body consists of an approximately 0.1 mm thick scandium oxide-containing, porous tungsten layer having a density of approximately 83% of theoretical density, on a 0.7 mm thick porous tungsten layer having a density of approximately 75% of theoretical density. Compared with cathodes of a homogeneous composition, that is to say cathodes which are provided with emission-stimulating material throughout the entire cathode body, this has the advantage that a greater quantity of emitter material can be stored.

It is a disadvantage of the prior art method that it is of poor utilization for the manufacture of cathodes whose emitting surface is not flat, but curved. On compressing powder provided with a top layer of a different composition in a press the die of which has a curved surface, it was found experimentally that, after pressing, the top layer was not uniformly distributed over the surface, but was shifted to the side edges of the mould. This results in a non-uniform by distributed emission of electrons, immediately or after some time in the future.

SUMMARY OF THE INVENTION

It is an object of the invention to provide a method by which it is possible to provide in a simple way a cathode with a curved emitting surface, with a uniformly distributed top layer.

To that end, a method according to the invention is characterized in that a first powder is compressed in a first pressing operation at a first pressure to form a coherent moulding, the first pressure being insufficient to break powder grains to a significant extent, and thereafter the moulding is coated with a top layer of a second powder, whereafter the whole assembly is compressed at a second, higher pressure, whereby the powder grains are broken to a significant extent.

After the first pressing operation, the surface of the moulding comprises coarse powder grains, which enables an appropriate adhesion of the top layer to this surface, so that during the second pressing operation a top layer is produced which is uniformly distributed over the surface of the moulding and is not sheared off.

A practical embodiment of the method in accordance with the invention, is characterized in that the first pressure is at least substantially in the range from $1*10^7$ Pa to $8*10^7$ Pa. This corresponds to pressures between 100 bar and 800 bar.

Experiments have shown that a first pressure within these values is satisfactory. Too high a pressure results in the powder grains breaking, which has a negative effect on the adhesion of the top layer to the imperfect moulding. Too low a pressure results in the cohesion of the moulding after the first pressing operation. Both circumstances may result in shearing off of the top layer.

A further embodiment of the method according to the invention, is characterized in that the first powder is shaken before and/or during the first pressing operation.

Shaking improves the homogeneity of the first powder and appropriately fills the space between the upper and lower dye of the press mould. This tends to prevent the occurrence of holes and closed pores in the pressed dispenser cathode, which improves the cohesion of the moulding after the first pressing operation. An improved cohesion reduces the risk of rejects. In addition, the uniform distribution and resistance to shearing of the top layer is improved. It is also important that no excessive inhomogeneities occur at the moulding surface. This also has the advantage that the relative spread in properties among lots of the dispenser cathodes after sintering is reduced.

In a further preferred embodiment, the first powder has an average grain size which exceeds the average grain size of the second powder.

This has an advantageous influence on the adhesion of the top layer to the moulding and on the uniform distribution of the top layer.

In a still further preferred embodiment of the method according to the invention, the average grain size of the first powder is in the range of from about 20 to 150 $\mu$m.

Experiments have proved that this grain size ensures a sufficient cohesion of the dispenser cathode moulding and of the adhesion of the top layer.

Preferably, the second powder has an average grain size in the range of from about 1 to 20$\mu$.

Experiments have proved that this grain size provides an appropriate adhesion of the top layer to the moulding.

The method is particularly suitable for manufacturing cathodes having an emissive surface with a characteristic size greater than 1 cm, at which the above-described disadvantage of the known method is more pronounced. A characteristic size exceeding 1 cm must here be understood to mean, for example, that the diameter of the emissive surface exceeds 1 cm, for a rotationally symmetric surface, or that a diagonal exceeds 1 cm, for a polygonal surface. Such cathodes are used in particular in travelling-wave tubes, clystrons and transmitter tubes.

The invention also relates to a cathode manufactured according to an electron device such as the method, and to a travelling-wave tube, a clystron, or a transmitter tube comprising a cathode manufactured according to the method.

BRIEF DESCRIPTION OF THE DRAWING

Some embodiments of the invention will now be described in greater detail by way of example with reference to the accompanying drawing in which:

FIG. 3 shows in a cross-section a cathode manufactured according to the method of the invention in a;

The Figures are schematical and not to scale, corresponding components in the several embodiments usually having the same reference numerals.

DESCRIPTION OF THE PREFERRED EMBODIMENT

Figure 1:
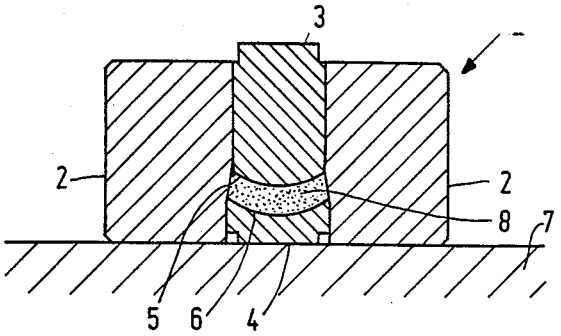
FIG. 1 is a schematic cross-section view of a cathode body in a press suitable for use in the method according to the invention.

FIG. 1 shows a press suitable for use in practicing the method. This press 1 is comprised of a holder 2, which includes dies 3 and 4 having curved surfaces 5 and 6. The dies 3 and 4 are freely movable in press 1. Press 1 is supported by supporting member 7. A cathode body 8 is shown pressed between the dies 3 and 4.

Figure 2A:
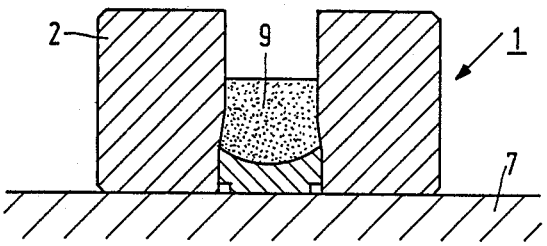
FIGS. 2*a* through 2*d* illustrate a sequence of steps of an embodiment of the method.
Figure 2B:
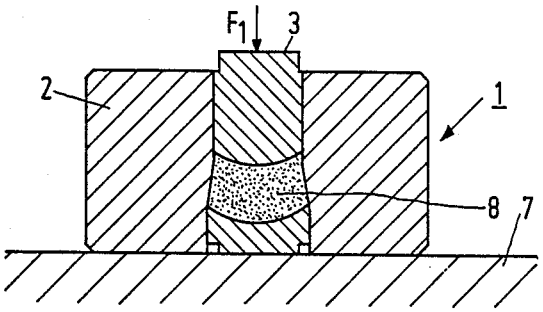
Figure 2C:
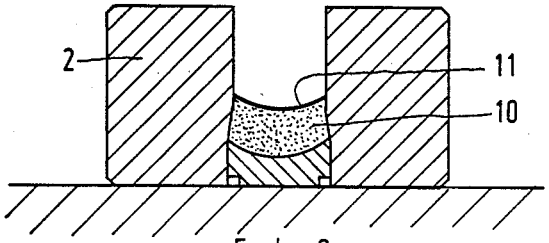
Figure 2D:
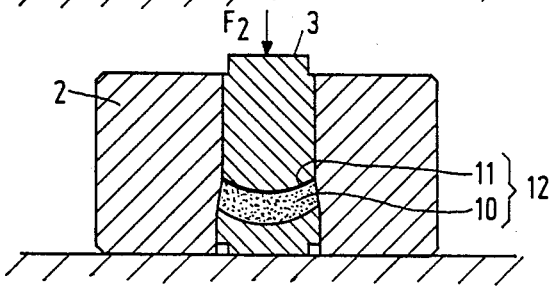

FIGS. 2*a* through 2*d* illustrate a sequence of steps of an embodiment of the method of the invention. In a first step shown in FIG. 2*a*, press 1 containing die 4 is partially filled with tungsten powder 9. In this embodiment the tungsten powder has an average grain size of about 100 μm. This powder is shaken a few times. This causes the powder to be distributed somewhat over a cavity 10 in holder 2. Die 3 is inserted in holder 2. Thereafter the press mould 1 is shaken, which also includes turning the press mould 1 upside down a few times. This promotes the homogeneity of the powder and consequently the subsequent homogeneity and cohesion of the pressed moulding, in that the space between the two dies is completely filled. If necessary, this shaking procedure is repeated. Die 3 can then be moved further into holder 2. This can be continued until the powder 9 does not compact any further. Thereafter, as is shown in FIG. 2*b*, the tungsten powder 9 is compressed in a first pressing operation by exercising a force $F_1$ on die 3. In this embodiment, the pressing surface of die 3 is a section of a substantially rotationally symmetric surface having a diameter of 22 mm. In this embodiment the force $F_1$ amount of about $1.5*10^4$N. The pressure exercised during this pressing operation is sufficient to compress the powder 9 to form a coherent moulding 10, but not high enough to break the powder grains to a significant extent. After the pressing pressure has been removed, moulding 10 is provided, as is shown in FIG. 2*c*, with a top layer 11, in this example consisting of a powder having an average grain size of about 6 μm and consisting of 95% by weight of tungsten and 5% by weight of $Sc_2O_3$. The top layer is applied, for example, by brushing or showering. Further emission-stimulating materials which can be added to the tungsten powder are, for example, scandium hydride or other scandium compounds or other metals such as osmium, iridium, ruthenium, or rhenium or compounds of these metals. In this embodiment the top layer has a thickness of about 100 μm As is shown in FIG. 2*d*, the overall assembly is now compressed to form the body 12 by exercising a force $F_2$ on die 3. This top layer 11 is uniformly distributed over the moulding 10. The pressure excercised during this second pressing operation is sufficiently high to cause the powder grains to fracture to a significant extent. In this embodiment $F_2$ amounts to about $2.5*10^5$N and it was found that after this second pressing operation the average particle size is about 2 to 3 μm.

Figure 3:
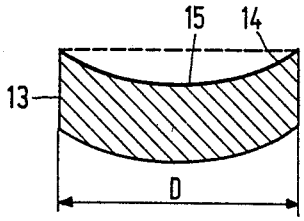

FIG. 3 shows a cathode manufactured according to the method of the invention. This cathode 13, which has a diameter D of 22 mm is provided with top layer 14 on a curved surface 15. Cathodes of this size are used inter alia in travelling-wave tubes, gyratrons, clystrons and transmitter tubes.

After the second pressing operation the body is sintered in a known manner, for example for two hours at a temperature of about 1800° C. in a hydrogen atmosphere. Thereafter the body is impregnated in a known manner, for example with Ba-Ca-Al compounds. It is alternatively possible to impregnate the body, after sintering, with, for example, copper so that it is possible to further work the body, for example or a lathe or by spark erosion.

Figure 4A:
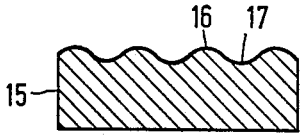
FIGS. 4*a* through 4*c* show in cross-section further embodiments of cathodes manufactured according to the method of the invention.
Figure 4B:
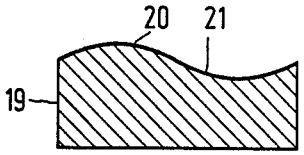
Figure 4C:
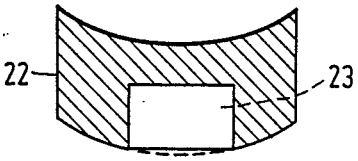

The method is not limited to the manufacture of a cathode as shown in FIG. 3. FIGS. 4*a*, 4*b* and 4*c* show some further examples of cathodes manufactured in accordance with the method of the invention. FIG. 4*a* shows a cathode 16 having a top layer 17 on a ribbled surface 18. FIG. 4*b* shows a cathode 19 provided with a top layer 20 on a sinusoidal surface 21. FIG. 4*c* shows a cathode 22 similar to the cathode 13 of FIG. 3. This cathode is provided with a cavity 23 in which, for example, a heating element can be positioned. It is not necessary for the cathode to be rotational-symmetrical; square, rectangular or polygonal cathodes can also be manufactured according to the method of the invention. Nor is it necessary for the emission surface of the cathode to be concave; cathodes having convex emissive surfaces can likewise be manufactured.

Figure 5:
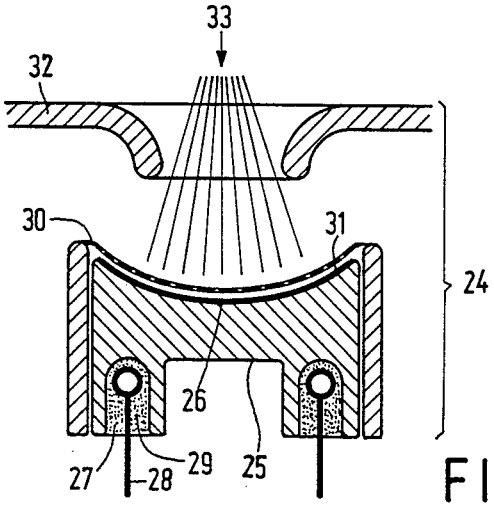
FIG. 5 is a schematic cross-section view of an electron gun comprising a cathode manufactured according to the method of the invention, suitable for use in a clystron.

FIG. 5 is a schematic cross-section view of an electron gun comprising a cathode manufactured according to the invention and suitable for a clystron. Here the electron gun 24 includes a cathode 25, provided with a top layer 26, manufactured according to the invention. A heating element 28 is located in cavity 27. This heating element is secured in the cavity 27 by means of electrically insulating material 29. In addition, electron gun 24 includes an anode 30 which has a plurality of apertures 31, and acceleration electrode 32. It is further known from the prior art that the electron gun may be provided with still further acceleration and/or focussing electrodes. Pulsed potential differences between the cathode 25 and the anode 30 and between the anode 30 and focussing electrode 31 generate electron beams 33. By applying an emission-stimulating top layer 26 in accordance with the method of the invention, the electron emission of the surface of cathode 25 is improved. This renders it possible to increase the maximum current or to reduce the temperature of the cathode. This generally has an advantageous effect on the operating life of the cathode.

It will be obvious that for a person skilled in the art many variations are possible within the scope of the invention. For example, other top layers may be provided which only differ from the rest of the body as regards the average particle size.

What is claimed is:

1. A method of manufacturing a dispenser cathode having a curved emitting surface comprising a porous cathode body predominantly comprising a refractory metal or refractory metal alloy and having a top layer which differs from the rest of the cathode body, the method comprising pressing the powder to form a body, characterized in that in a first step a first powder is pressed in a first pressing operation at a first pressure to form a coherent moulding, the first pressure being insufficient to break powder grains to a significant extent, the moulding thereafter in a second step is coated with a top layer of a second powder, whereafter in a third step the whole assembly is compressed at a second, higher pressure, whereby the powder grains are broken to a significant extent.

2. A method as claimed in claim 1, in which the first pressure is in the range of from about $1*10^7$ Pa to $8*10^7$ Pa.

3. A method as claimed in claim 1 in which the first powder is shaken before and/or during the first pressing operation.

4. A method as claimed in claim 1, in which the first has an average powder grain size which exceeds the average grain size of the second powder.

5. A method as claimed in claim 1 in which the average grain size of the first powder is in the range of from about 20 to 150 $\mu$m.

6. A method as claimed in claim 1, in which the second powder has an average grain size which is in the range of from about 1 to 20 $\mu$m.

7. A cathode manufactured according to the method of claim 1.

8. A cathode as claimed in claim 7, characterized by an emissive surface having a size exceeding 1 cm.

9. A travelling-wave tube comprising the cathode as claimed in claim 7.

10. A clystron comprising a cathode as claimed in claim 7.

11. A transmitter tube comprising a cathode as claimed in claim 7.

* * * * *